United States Patent [19]

Zorn

[11] 4,412,680

[45] Nov. 1, 1983

[54] FLOATING ARCADE

[76] Inventor: Thomas E. Zorn, 3302 Burt St., No. 20, Omaha, Nebr. 68131

[21] Appl. No.: 23,648

[22] Filed: Mar. 26, 1979

[51] Int. Cl.[3] ..... A63F 7/06; A63F 7/38; A63F 9/02

[52] U.S. Cl. ..... 273/85 H; 273/126 R; 273/349; 273/350; 273/356; 273/357

[58] Field of Search ..... 273/101, 95 R, 102 S, 273/105.2, 85 H, 105 R, 126 R, 129 F, 349, 350, 355, 356, 357; 272/1 B; 46/93, 95

[56] References Cited

U.S. PATENT DOCUMENTS

| | | | |
|---|---|---|---|
| 1,736,244 | 11/1929 | Baker | 273/105.2 X |
| 2,130,820 | 9/1938 | Trumbull | 273/101 X |
| 2,628,451 | 2/1953 | Goldfarb | 46/93 |
| 2,835,495 | 5/1958 | Lohr et al. | 273/101 |
| 2,920,419 | 1/1960 | Giannone | 272/1 B X |
| 3,434,716 | 3/1969 | Schwartz | 273/101 X |
| 3,477,723 | 11/1969 | Djedda | 273/101 |
| 3,509,584 | 5/1970 | Sable | 272/1 B X |
| 3,778,060 | 12/1973 | Lakeman | 273/102 S |
| 3,895,801 | 7/1975 | Baird | 273/95 R |

FOREIGN PATENT DOCUMENTS

| | | | |
|---|---|---|---|
| 152015 | 8/1937 | Austria | 273/85 H |
| 2254072 | 5/1974 | Fed. Rep. of Germany | 273/85 H |
| 1112957 | 11/1955 | France | 273/85 H |

*Primary Examiner*—Paul E. Shapiro

*Attorney, Agent, or Firm*—Zarley, McKee, Thomte, Voorhees & Sease

[57] ABSTRACT

A floating arcade includes a housing in the form of an elongated transparent enclosure with a water pistol operatively connected at one end for directing a jet of water toward targets situated within the housing for striking the same. A siphon tube extends downwardly from the water pistol for immersion in the body of water on which the housing is floatably supported to draw water from the body of water in response to operation of the water pistol. The housing may be floatably supported by buoyant material secured to the underside thereof. The bottom wall of the housing may be perforated for drainage of water from the housing back to the body of water and may be removable for cleaning purposes. In an alternate embodiment, water pistols may be operatively connected to both ends of the housing with a target supported for longitudinal sliding movement between opposite ends of the housing.

10 Claims, 7 Drawing Figures

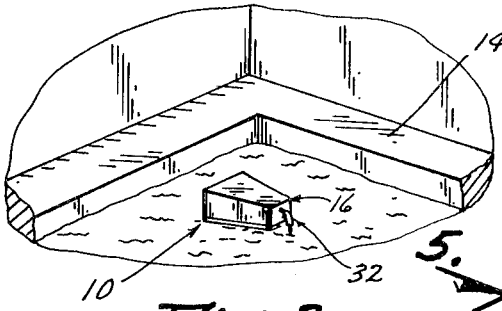
Fig. 2
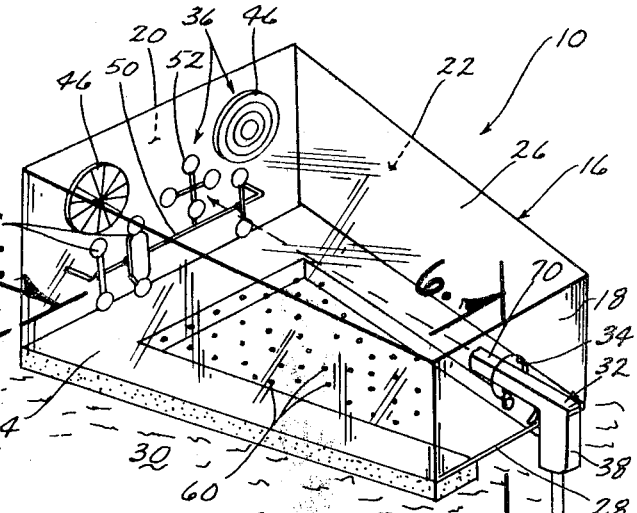
Fig. 3
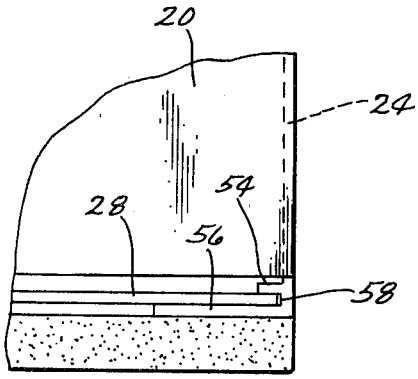
Fig. 5
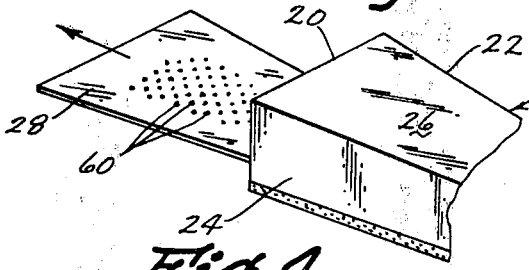
Fig. 4
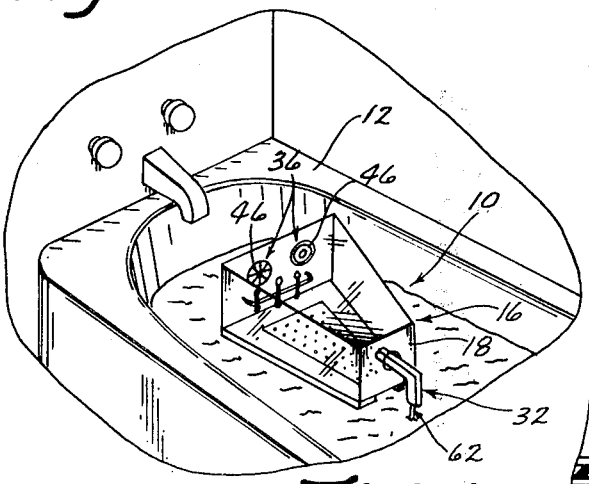
Fig. 1
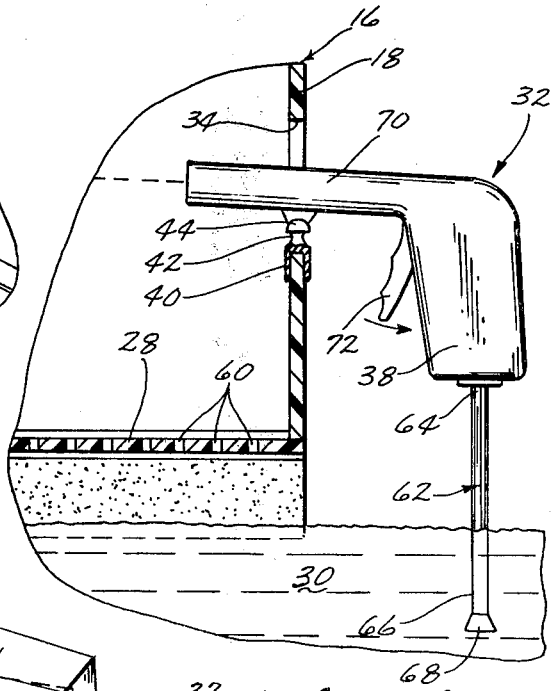
Fig. 6
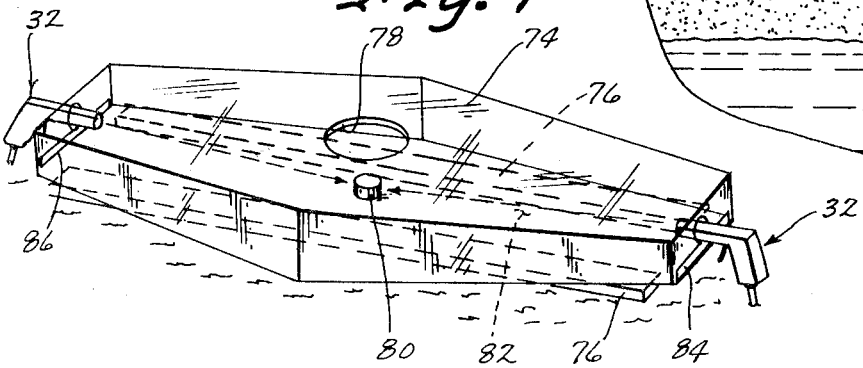

FLOATING ARCADE

BACKGROUND OF THE INVENTION

The present invention is directed generally to a toy and more particularly to a floating arcade including a housing with target means therein and a water pistol adapted to receive its supply of water directly from the body of water on which the housing is floatably supported.

It is an endless problem for parents to induce their children to take baths. It is believed that this is at least partially because children view taking a bath as a chore rather than as amusement. Accordingly, there is a need for a toy or game apparatus designed for use in a bathtub in order to entice children to take baths.

Target games for water pistols and the like are known in the art but all have certain shortcomings. Many require a source of high pressure water for operating the water pistol. This is an uneconomical and probably unsuitable requirement for use in a child's toy. Other known targets which are separate integral structures from the water gun means are generally unsuitable for two reasons. First, the target and the gun may be easily separated so that is one is lost, the other is unusable. Secondly, the target is not enclosed with the result that water directed at the target is splashed onto the surrounding area. Finally, the conventional water pistol must be regularly refilled for continued use, such refilling being time consuming and difficult for children of young ages.

These problems are believed to be resolved by the floating arcade of the present invention.

SUMMARY OF THE INVENTION

The floating arcade of the present invention includes an elongated housing adapted to be floatably supported on a body of water. A water pistol is operatively connected to one end of the housing for directing a jet of water at a target supported within the housing. Since the arcade may be constructed of a size for use in a bathtub, the present invention provides an ideal enticement for children to get into the bathtub. The water pistol requires no source of high pressure water for its operation and therefore may be safely used by children. Both the targets and water pistol are contained within or supported on the housing so that all of the elements of the arcade will remain intact and together at all times. Since the target is enclosed within the housing, the jet of water directed at the target by the water pistol is substantially confined within the housing so as to eliminate the problem of water splashing off the target onto the surrounding area. Finally, the water pistol never needs refilling because it has a virtually endless supply of water. A siphon tube extends downwardly from the water pistol for immersion in the body of water on which the housing is floatably supported to draw water into the pistol when it is operated. The jet of water from the pistol drains back from the housing to the body of water to complete the cycle.

Accordingly, the primary object of the present invention is to provide a floating arcade type toy.

A further object is to provide a floating arcade wherein both the target and pistol are operatively connected to the housing therefore.

A further object is to provide a floating arcade wherein the target is enclosed within a housing to confine the jet of water therein.

A further object is to provide a floating arcade wherein the water pistol thereof is provided with an endless supply of water.

Finally, it is an object of the present invention to provide a floating arcade which is economical to manufacture, durable in use and refined in appearance.

BRIEF DESCRIPTION OF THE DRAWINGS

FIG. 1 is a perspective view of the arcade of the present invention floatably supported in a bathtub;

FIG. 2 is a perspective view of the arcade floatably supported in a swimming pool;

FIG. 3 is an enlarged perspective view of the floating arcade;

FIG. 4 is a partial perspective view of the arcade showing the bottom wall slidably removed therefrom;

FIG. 5 is an enlarged detail end view of the housing taken along 5—5 in FIG. 3;

FIG. 6 is an enlarged detail partially sectional side view taken along line 6—6 in FIG. 3; and FIG. 7 is an perspective view of an alternate embodiment of the floating arcade.

DESCRIPTION OF THE PREFERRED EMBODIMENTS

The floating arcade 10 of the present invention is shown floating in a bathtub 12 in FIG. 1 and in the swimming pool 14 in FIG. 2.

Referring to FIG. 3, the floating arcade 10 includes elongated housing 16 having a front wall 18, a back wall 20, opposite sidewalls 22 and 24 and top and bottom walls 26 and 28 respectively. Housing 16 is floatably supported on a body of water 30 by a generally U-shaped strip 32 of buoyant material such as Styrofoam, which is secured to the underside of the housing along the back and both sidewalls thereof. The specific shape or material of the means for floatably supporting the housing 16 are not critical to the present invention so long as housing 16 is floatably supported.

A water pistol 32 is operatively connected to the housing 16 adjacent the front end thereof, as shown in FIGS. 3 and 6. The pistol 32 protrudes through an opening 34 in the housing front wall 18 for directing a jet of water at a target within the housing. The handle portion 38 of the water pistol is situated exteriorly of the housing so that it may be operatively gripped by a child. The water pistol may be conveniently connected to the housing by a simple bracket 40 which straddles the bottom of opening 34 and supports a ball connector 42 thereon. A coacting socket 44 on the underside of the water pistol 32 coacts with the ball connector 42 to provide a universal swivel connection between the water pistol and housing.

The targets within the housing are arranged in spaced relation from the water pistol 32 and are shown in FIG. 3 as including stationary targets 46 mounted on back wall 20 and movable targets 48 rotatably supported on a cross bar 50 supported forwardly of back wall 20. A wind wheel type target 52 is also rotatably supported relative to cross bar 50. The swivel connection 42/44 between the water pistol 32 and front wall 18 enables the water pistol to be oriented for striking each of the targets.

Referring to FIG. 4, it is seen that bottom wall 28 is slidably removable from the housing 16. In FIG. 5 it is seen that housing sidewall 24 has a pair of inwardly directed flanges 54 and 56 on the lower end thereof which define a slot 58 for slidably supporting the bottom wall 28 as shown. A similar pair of flanges are formed on the lower end of sidewall 22.

It will be appreciated that the housing 16 thus forms an enclosure for confining the jet of water directed at the targets 36 by the water pistol 32. The moving targets 48 and 52, in particular, tend to splash water in all directions when struck by a jet of water but all of these splashes are confined within the housing. Nevertheless, since the various walls of the housing are preferably transparent, they do not interfere with the child's view of any portion of the arcade.

Water which accumulates in the housing is cycled back to the body of water 30 automatically since the bottom wall 28 includes multiple openings or perforations 60 as seen in FIGS. 3 and 4.

An important feature of the present invention is the siphon tube 62 (FIG. 6) which has one end 64 operatively connected to the water pistol 32 for supplying water thereto and the opposite end 66 adapted for immersion in the body of water in which the housing 16 is floatably supported to draw water therefrom in response to operation of the water pistol 32. Note that the siphon tube 62 preferably extends into the water sufficiently so that it remains immersed in all pivoted positions of the water pistol 32. A filter 68 may be fitted onto the lower end of siphon tube 62 to keep debris out of the pistol.

The specific mechanism for jetting liquids from the pistol is not critical to the present invention. Many such apparatus are currently used in connection with spray bottles for watering plants and the like. See for example U.S. Pat. No. 3,061,202 wherein there is shown an adjustable mechanism capable of both spraying and jetting liquids. Such a mechanism is operatively supported within the water pistol 32 so that water drawn up through siphon tube 62 is directed in a jet outwardly through the barrel portion 70 of water pistol 32 in response to a rearward movement of the trigger or operating lever 72 as indicated by arrow 74 in FIG. 6.

In the alternate embodiment of the invention shown in FIG. 7, a pair of water pistols 32 are operatively mounted by ball and socket connections 42/44 to opposite ends of an elongated housing 74. Housing 74 is floatably supported on a pair of buoyant strips 76. A center opening 78 is formed in the housing top wall for dropping a puck 80 onto a flat playing surface 82. The lower ends of both end walls of the housing are open as at 84 and 86 to allow the puck 80 to pass therethrough when forced toward the end wall by a jet of water from the pistol at the opposite end of the housing. Accordingly, there is provided a hockey type game.

Whereas the invention is shown in FIGS. 1 and 2 in use in a bathtub and swimming pool, it will be appreciated that it is equally suitable for use at the beach or any other body of water which may floatably support the housing 16 and provide an endless supply of water for the water pistol 32. In addition, the floating arcade of the present invention has appeal for children of many ages. Young children will be amused by the splashing action within the housing and older children are challenged to master the skill of quickly and accurately striking the various targets.

Whereas preferred embodiments of the invention have been disclosed herein, the present invention is intended to embrace all of the alternatives, modifications and variations that come within the broad scope of the appended claims.

I claim:

1. A floatable toy apparatus comprising an elongated housing having opposite ends, means for floatably supporting said housing on a body of water, water gun means operatively connected to said housing adjacent one end thereof, and target means supported on said housing in spaced relation from said water gun means, said water gun means being operative to direct a jet of water toward said target means for striking the same, said water gun means including a siphon tube having one end operatively connected to said water gun means for supplying water thereto and an opposite end adapted for immersion in the body of water on which said housing is floatably supported to draw water therefrom in response to operation of said water gun means, and said housing comprising a substantially transparent enclosure around said target means whereby the jet of water directed at the target means by said water gun means is substantially confined within said housing, said housing including means for draining water therein back to said body of water.

2. The apparatus of claim 1 wherein said housing includes longitudinally spaced apart front and back walls, said front wall having an opening therethrough for insertion of said water gun means therethrough, and said target means being supported adjacent said back wall.

3. The apparatus of claim 2 wherein said target means includes a stationary target and a movable target.

4. The apparatus of claim 1 wherein said water gun means is operatively connected to said housing by a ball and socket connection.

5. The apparatus of claim 1 wherein said housing includes a removable bottom wall.

6. The apparatus of claim 1 wherein said housing includes a bottom wall having openings therethrough for drainage of water back to said body of water.

7. The apparatus of claim 6 wherein said bottom wall is supported in spaced relation above said body of water.

8. The apparatus of claim 1 wherein said means for floatably supporting said housing comprises a length of buoyant material secured to the underside of said housing.

9. The apparatus of claim 1 further comprising second water gun means operatively connected to said housing adjacent the opposite end thereof.

10. The apparatus of claim 9 wherein said housing includes a generally flat bottom wall and said target means includes a puck-like object supported on said bottom wall for sliding movement between said opposite ends.

* * * * *